US005085009A

United States Patent [19]

Kinumura et al.

[11] Patent Number: 5,085,009

[45] Date of Patent: Feb. 4, 1992

[54] CARRIER FOR SUPPORTING WORKPIECE TO BE POLISHED

[75] Inventors: Akira Kinumura, Nara; Katsuhiko Koretomo, Takatsuki; Shuichi Yura, Nakama; Tatsuhiko Kuwano, Osaka; Tsuguji Kimura, Soka, all of Japan

[73] Assignees: Sekisui Kagaku Kogyo Kabushiki Kaisha, Osaka; Okabe Mica Co., Ltd., Fukuoka; Fuji Spinning Co., Ltd., Tokyo, all of Japan

[21] Appl. No.: 513,090

[22] Filed: Apr. 23, 1990

[30] Foreign Application Priority Data

May 2, 1989 [JP] Japan ..... 1-112930

[51] Int. Cl.[5] ..... B24B 5/00

[52] U.S. Cl. ..... 51/131.1; 51/129; 51/133

[58] Field of Search ..... 51/131.1, 129, 109 R, 51/133, 132, 131.2, 131.4, 131.3

[56] References Cited

U.S. PATENT DOCUMENTS 4,593,495 6/1986 Kawakami et al. ..... 51/133
4,739,589 4/1988 Brehm et al. ..... 51/131.1

OTHER PUBLICATIONS

"Ultra-Precision Polishing & Mirror Polishing Technique", pp. 375-383, Keiei—Kaihatsu Center, Osaka, Japan, 1987, No Translation Has Been Provided.

*Primary Examiner*—Bruce M. Kisliuk
*Assistant Examiner*—Lawrence Cruz
*Attorney, Agent, or Firm*—Wenderoth, Lind & Ponack

[57] ABSTRACT

A carrier for supporting workpieces to be polished is composed of an integrated mica laminated sheet. The mica laminated sheet is impregnated with a thermo-setting resin. The carrier has a low warp ratio and can be made thin with a sufficient mechanical strength and accuracy of thickness.

5 Claims, 3 Drawing Sheets

CARRIER FOR SUPPORTING WORKPIECE TO BE POLISHED

BACKGROUND OF THE INVENTION

The present invention relates to a workpiece carrier for a polisher and more particularly to a carrier used for polishing both surfaces of a workpiece to be polished, such as semiconductor wafers typified by a silicon wafer and a gallium arsenide (GaAs) wafer, thin glass, ceramics, artificial quartz, metal sheets, and so forth.

Polishing of both surfaces of a semiconductor wafer has been carried out by use of a double-sided polisher, which is shown in FIGS. 10 and 11, in the following way. First of all, polishing sheets 12, 14 are bonded to each of the opposed surfaces of upper and lower stools 11, 13 of a double-sided polisher 10. A plurality of carriers C equipped around their outer periphery with teeth meshing with a sun gear 15 and an internal gear 16 of the double-sided polisher 10, are disposed in such a manner as to attain the engagement between the teeth and the gears. Then, the semiconductor wafer W to be polished is inserted into each workpiece insertion hole 3 bored in each carrier and clamped by the upper and lower stools 11, 13. Thereafter, the sun gear 15 and the internal gear 16 are rotated so as to cause the rotation and revolution of the carriers C while a polishing solution is being charged between the upper and lower stools 11, 13 and to cause spiral movement of the semiconductor wafer W between these stools. At the same time, the upper and lower stools 11, 13 are rotated so that the polishing sheets 12, 14 and the polishing surfaces of the semiconductor wafer W come into mutual rubbing contact and the latter is ground. The conventional double-sided polisher is disclosed in Japanese technical literature entitled "CHOU-SEIMITSU KENMA KYOMEN KAKO GIJUTSU" (Ultra-precision Polishing & Mirror Polishing Technique), pages 375–383, Keiei-Kaihatsu Center, Osaka, Japan 1987.

Since the thickness of the semiconductor wafers has become thinner and thinner in recent years, carriers having a smaller thickness have been sought. It has also been required recently to polish a large number of workpieces by a single carrier or to increase the diameter of the carrier. Almost all the conventional carriers are made of a glass fiber-reinforced plastic sheet or a blue steel sheet.

However, if a thin carrier is produced from a glass fiber-reinforced epoxy sheet, the accuracy of the thickness is low and its warp ratio is as high as from 2 to 3% so that the semiconductor wafer is likely to jump out from the workpiece insertion hole 3 and become broken. Experiments have revealed an extreme difficulty in practice to reduce the warp ratio described above when a carrier was produced by a thin glass fiber-reinforced epoxy sheet.

On the other hand, the carrier made of a blue steel sheet is excellent in both the tooth strength and the thickness accuracy, but is not free from the same problems, in that when the thickness is small, it is likely that the warp of the sheet itself occurs, the workpiece jumps out and becomes broken, chipping occurs around the workpiece due to its collision against the carrier, and contamination due to metal ions may occur depending on the materials of the workpiece due to the direct contact of the workpiece with the metal surface.

SUMMARY OF THE INVENTION

In view of the problems with the prior art technique described above, an object of the present invention is to provide a novel carrier which has a low warp ratio, even though it is thin, excellent accuracy of thickness and, moreover, has sufficient strength.

Another object of the present invention is to provide a carrier composed of an integrated mica laminated sheet impregnated with a thermo-setting resin.

A further object of the present invention is to provide a thin carrier which is as thin as 30 microns.

Another object of the present invention is to provide a carrier which does not prcduce chipping due to collision of workpieces against the carrier.

In accordance with the present invention, a carrier comprises a mica laminate impregnated with a thermo-setting resin, the laminate having teeth on its periphery for mesh with a sun gear and an internal gear of a double-sided polisher and having a plurality of holes in its disc surfaces for holding workpieces.

In place of the single integrated mica laminate sheet described above, the carrier in accordance with the present invention may comprise a laminate body of the mica laminate and a metal ring plate embedded inside the peripheral edge of the mica laminate. The laminate body has teeth on its periphery for mesh with the sun gear and the internal gear of the double-sided polisher and has a plurality of holes in its disc surface for holding workpieces.

Alternatively, the laminate body may consist of the mica laminate sheet and a bored metal plate embedded in such a manner as to extend from the inner portions around the peripheral edge of the mica laminate sheet to the inner portions around the peripheral edges of the workpiece insertion holes, and teeth, similar to the above-described teeth and workpiece insertion holes, having a diameter smaller than those of the metal plates are formed.

In the present invention, the carrier is prepared as follows. First, a mica ore is prepared and beaten by a jet water stream to obtain mica flakes, and the resulting mica flakes are subjected to sheet making. The mica sheet is impregnated with a thermo-setting resin solution and then dried to obtain a prepreg of the epoxy-integrated mica. A plurality of prepregs are placed one upon another and hot-pressed to thereby provide an integrated mica laminate sheet. The integrated mica laminate sheet has at its periphery teeth meshing with a sun gear and an internal gear of a double-sided polisher. Insertion holes for workpieces are formed at the surface of the laminate sheet. If necessary, a metal ring can be embedded in an outer peripheral portion of the integral mica laminate sheet.

When mica is rendered flake-like by utilizing its cleavage property, it becomes a flake like mica having an extremely large aspect ratio (length of plane/thickness). Therefore, a mica sheet or a mica laminate sheet produced by impregnating the sheet with a thermo-setting resin and then setting the sheet has a structure wherein its planes parallel to one another are bonded. Since they can thus be integrated with a smaller amount of thermo-setting resin for bonding without deterioration of the properties of the mica, a high accuracy of thickness is obtained for a thin sheet, and warp hardly occurs, even in a thin sheet.

In the first aspect of the invention, the carrier comprises an integrated mica laminate sheet impregnated with a thermo-setting resin which is set, the laminate sheet having teeth on its periphery for mesh with a sun gear and an internal gear of a double-sided polisher and having a plurality of holes in its disc surfaces for holding workpieces.

In the second aspect of the invention, in place of the single integrated mica laminate sheet described above, the carrier may comprise a laminate body of the integrated mica laminate sheet and a metal ring plate embedded inside the peripheral edge of the mica laminate sheet, the laminate sheet having teeth on its periphery for mesh with the sun gear and the internal gear of the double-sided polisher and having a plurality of holes in its disc surface for holding workpieces.

In the third aspect of the invention, the laminate body may consist of the integrated mica laminate sheet and a bored metal plate embedded in such a manner as to extend from the inner portions around the peripheral edge of the integrated mica laminate sheet to the inner portions around the peripheral edge of the workpiece insertion holes, and teeth, similar to the above-described teeth and the workpiece insertion holes, having a diameter smaller than those of the metal plates, are formed.

In the fourth aspect of the invention, fiber layers impregnated with a thermo-setting resin and having a diameter greater than that of a round mica laminate sheet are laminated and bonded on both surfaces of the mica laminate sheet, and the teeth and workpiece insertion holes, which are the same as those of the first aspect of the invention, are formed on the outer periphery.

In the fifth aspect of the invention, an inorganic filler is mixed with the thermo-setting resin as the bonding layer in the fourth aspect of the invention.

The sixth aspect of the invention relates to a method of producing the carrier for holding workpieces of the fourth and fifth aspects of the invention. This method comprises coating and drying varnish made of a thermo-setting resin on a mica laminate sheet to obtain a round prepreg, laminating another prepreg having a diameter greater than that of the round prepreg and consisting of a thermosetting resinimpregnated fiber layer, heating and pressing the prepregs so as to extrude part of the thermo-setting resin coated on the mica laminate sheet to the outer periphery of the mica laminate sheet, setting the thermo-setting resin to interpose the mica laminate sheet from both of its surfaces by the thermo-setting resin-impregnated fiber layers and to obtain a laminate body, and forming teeth and workpiece insertions holes which are the same as those of the fourth aspect of the invention on the outer periphery of the mica laminate sheet.

The above and other objects and novel features of the present invention will become more apparent from the following detailed description when taken in conjunction with the accompanying drawings.

DESCRIPTION OF THE PREFERRED EMBODIMENTS

Hereinafter, the present invention will be described with reference to some preferred embodiments thereof shown in the accompanying drawings.

The term "parts" means "parts by weight". Incidentally, properties in the following embodiments are measured by the following measuring methods:

(1) Warp ratio: In accordance with (Japan Industrial Standards) JIS K6911

(2) Impact strength: Impact is repeatedly applied ten times at a swing-down angle of 15° and 30° by use of an Izod impact tester, the corrosion depth (mm) of the edge is measured and the measured value is used as the impact strength.

FIRST EMBODIMENT

Figure 1:
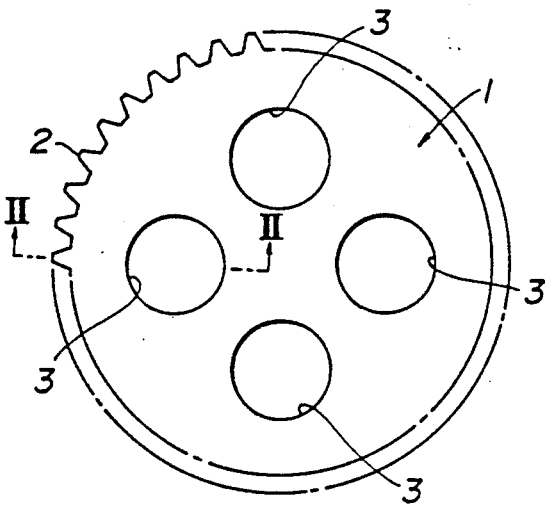
FIG. 1 is a plan view of a carrier according to a first embodiment of the present invention.
Figure 10:
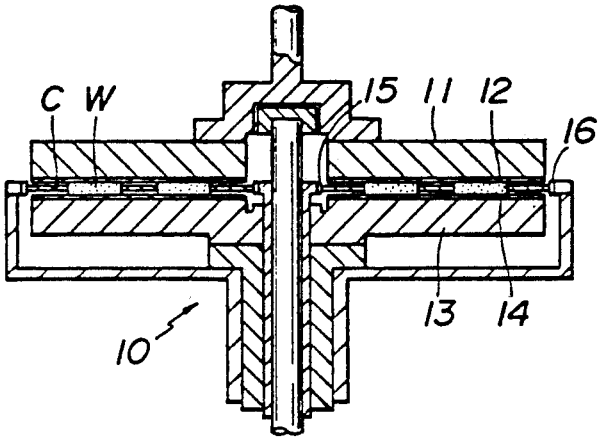
FIG. 10 (PRIOR ART)
FIG. 10 is a sectional view of a general double sided polisher to which the carrier of the present invention is applied.
Figure 11:
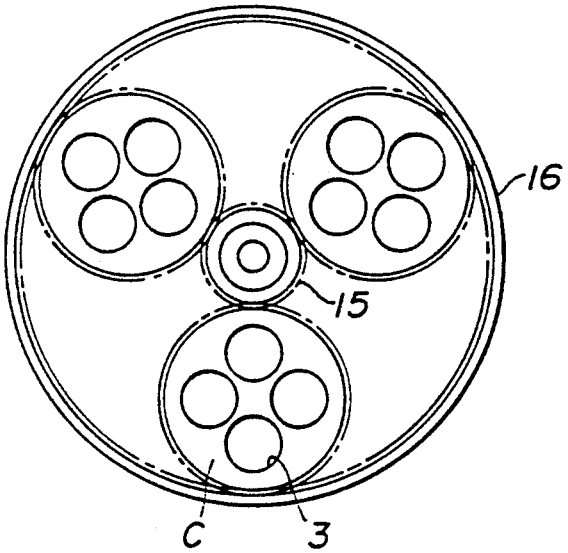
FIG. 11 (PRIOR ART)
FIG. 11 is a top plan view of a lower stool of the double-sided polisher shown in FIG. 10.

With reference to FIG. 1, teeth 2 meshing with a sun gear (15 in FIG. 10) and an internal gear (16 in FIG.10) of a double-sided polisher are formed by a customary thread cutting work around the outer periphery of a disc-like integrated mica laminate sheet 1 which is as thin as 0.35 mm in such a manner that the diameter of the pitch circle is 229 mm, the pitch of the teeth is 7 mm and an addendum is 5 mm. Four round workpiece insertion holes 3 each having a diameter of 77 mm are bored at the sheet surface portion of the laminate sheet 1 by a known cold punching method. As can be seen clearly from the partially enlarged sectional view of FIG. 2, the integrated mica laminate sheet 1 in this case is a laminate structure of five mica sheets la and is produced in the following way. First of all, a mica ore is beaten by a jet water stream to obtain mica flakes and the resulting flakes are subjected to sheet making by a sheet making machine in a thickness of 0.1 mm and a size of 500×1,000 mm. Each sheet is impregnated with 70 g of a thermo-setting resin solution having the following composition and dried for five minutes to obtain the prepreg of a epoxy-integrated mica:

| | |
|---|---|
| epoxy resin ("Sumiepoxy ELA128", product of Sumitomo Kagaku Kogyo Co.) | 125 parts |
| curing promoter (boron trifluoride monoethylamine, product of Sumitomo Kagaku Kogyo Co.) | 4 parts |
| toluene | 124 parts |
| methanol | 123 parts |
| methyl ethyl ketone | 124 parts |
| resin concentration 25% | 500 parts |

Five prepregs of the integrated mica are put one upon another and hot-pressed at 160° C. and 40 Kgf/cm$^2$ for one hour, providing thereby the 0.35 mm-thick integrated mica laminate sheet 1 described above.

When flake-like fine mica plates are formed by utilizing the cleavage property of mica as described above, the aspect ratio becomes as great as from about 100 to about 200. When mica plates are subjected to sheet making, each plane of the flake-like fine mica plates is arranged parallel to one another. When the mica plates are impregnated with the thermo-setting resin and hot-pressed, the mica flakes become parallel so that the amount of the adhesive becomes smaller, the characteristic properties of mica are not lost and warp and torsion become extremely small with a high accuracy of the thickness. The amount of adhesive is from 5 to 40 wt % and preferably from 10 to 25 wt %. Incidentally, when compared with a commercially available carrier made of a glass fiber-reinforced epoxy sheet having the same dimension, the properties are listed below.

| | Embodiment 1 | Comparative Example |
|---|---|---|
| warp ratio (%) | 0.2 | 2.6 |
| thickness (mm) | 0.35 ± 0.02 | 0.35 ± 0.08 |

Remarks: The thickness is measured in accordance with JIS C2116, 5.1.

As a comparative polishing test between the carrier of the first embodiment of the invention and the commercially available carrier made of the glass fiber-reinforced epoxy sheet, a GaAs wafer having a diameter of 76 mm was polished by use of a double-sided polisher (product of SPEEDFAM Co., Ltd., Model SFDL-9-B 5P). As a result, it was found that the durability of the carrier was 60 hours in the conventional carrier whereas it was 80 hours in the carrier of the first embodiment of the invention, and the number of wafers causing a crack was one per 40 GaAs wafers tested in the case of the conventional carrier, whereas it was zero in the case of the carrier of the first embodiment. The measurement results of the properties are shown in table 1.

SECOND EMBODIMENT

When the diameter of the carrier is relatively small, the force acting on the teeth 2 for rotating the carrier is not very great, and there is no problem in the structure of the first embodiment, wherein all the portions of the carrier, inclusive of the portions of the teeth 2, consist of the integrated mica laminate sheet 1. However, when the force acting on the teeth 2 becomes greater with an increasing diameter of the carrier, the strength of the integrated mica laminate sheet 1 is likely to be insufficient. In such a case, it is advisable to embed a metal ring sheet 4 around the inner portion of the round periphery of the integrated mica laminated sheet 1 which is impregnated with the thermo-setting resin, as in the second embodiment shown in FIG. 3, in order to reinforce the portions of the teeth 2.

An example of the production method of such a carrier will be explained with reference to FIGS. 3 and 4. A stainless steel ring sheet 4 which is 0.2 mm thick, 253 mm in an outer diameter and 213 mm in inner diameter is first prepared, and a three-layered integrated mica laminate sheet 1*b* having the same thickness and an outer diameter substantially equal to the inner diameter of the metal ring sheet 4 is placed inside the metal ring sheet 4 and interposed between upper and lower entire surfaces that are 0.075 mm-thick integrated mica sheets 1*c*, 1*c*', and integrated with them by an adhesive ("EP-330", product of Cemedyne Co.). The teeth 2 are formed around the outer periphery, and four workpiece insertion holes 3 are bored on the surfaces of the sheet 1*b*. The strength of the teeth 2 is reinforced by the metal ring sheet 4 and by the integrated mica sheets 1*c* 1*c*'.

Figure 2:
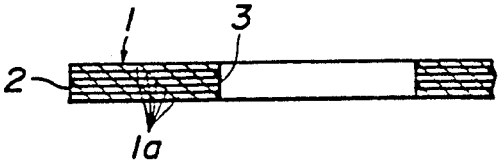
FIG. 2 is a partially enlarged sectional view taken along line II—II in FIG. 1.
Figure 3:
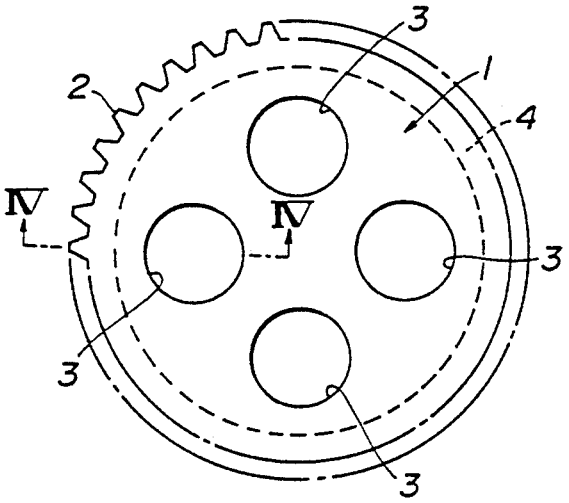
FIG. 3 is a plan view of a carrier according to a second embodiment of the present invention.
Figure 4:
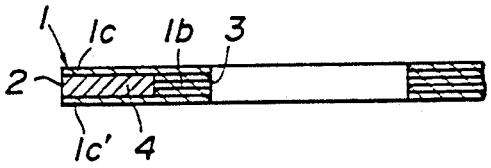
FIG. 4 is a partially enlarged sectional view taken along line IV—IV in FIG. 2.

The warp ratio and thickness accuracy of the second embodiment of FIGS. 3 and 4 are substantially similar with those of the first embodiment of FIGS. 1 and 2. When the comparative polishing test was conducted for polishing the GaAs wafers having a diameter of 76 mm using this carrier in the same way as in the first embodiment, it was found that the durability of the carrier was only 70 hours in the case of the conventional carrier but more than 150 hours in the carrier of the second embodiment of the invention. The number of wafers with cracks was two in the case of the conventional carrier when 40 wafers were tested, whereas it was only one in the case of the carrier of the second embodiment of the invention. The measurement results of the properties are shown in table 1.

THIRD EMBODIMENT

Figure 5:
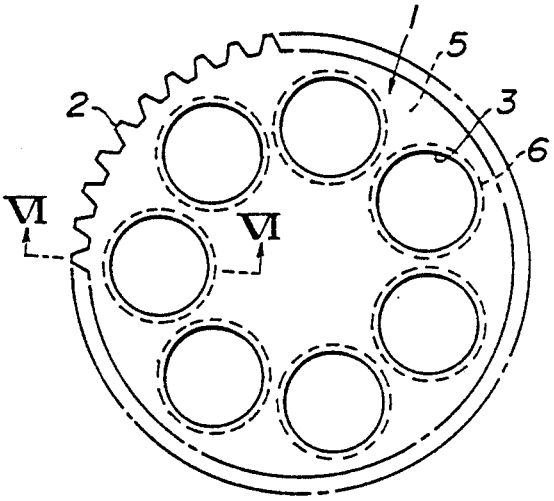
FIG. 5 is a plan view of a carrier according to a third embodiment of the present invention.
Figure 6:
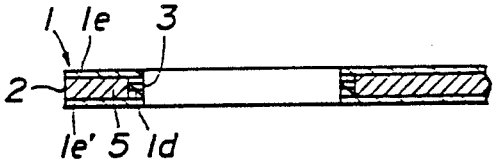
FIG. 6 is a partially enlarged sectional view taken along line VI—VI in FIG. 5.

FIGS. 5 and 6 show the third embodiment of the invention. In order to increase the mechanical strength not only of the portion of the teeth 2 but also of the entire portion of the carrier, it is advisable to embed a bored metal sheet 5 into the intermediate layer portion of the integrated mica laminate sheet 1, the bored metal sheet 5 extending from the inner portions around the peripheral edge of the integrated mica laminate sheet 1 to the inner portions around the peripheral edges of the plurality of workpiece insertion holes, as shown in FIGS. 5 and 6. Its production example will be explained with reference to FIGS. 5 and 6. First of all, a bored metal sheet 5, made of a stainless steel and having seven holes 6 each having a diameter of 106 mm, is prepared inside a disc which is 0.2 mm thick and has an outer diameter of 448 mm. A three-layered integrated mica sheet 1*d*, each layer having the same thickness (i.e., 0.2 mm) and the same diameter (i.e., 106 mm), is placed into each hole 6 and is then sandwiched between 0.075 mm-thick integrated mica sheets 1*e* and 1*e*' and bonded integrally by an adhesive. Each workpiece insertion hole 3, having a diameter of 101 mm, which is smaller than the diameter (i.e., 106 mm) of the hole 6 of the metal sheet 5, is then bored at the position of each hole 6 and the teeth 2 are formed around the periphery of the metal sheet 5 and the integrated mica sheets 1*e*, 1*e*'.

The warp ratio and accuracy of thickness of the carrier in the third embodiment of FIGS. 5 and 6 are substantially the same as those of the first and second embodiments. When the comparative polishing test was conducted for a silicon wafer having a diameter of 100 mm, it was found that carrier durability was only about 70 hours for the conventional product whereas it was more than 150 hours for the third embodiment. The number of silicon wafers having a crack was one per 70 silicon wafers tested in the case of the conventional products, whereas it was zero in the third embodiment of the invention. The measurement results of the properties are shown in table 1.

FOURTH EMBODIMENT

Figure 7:
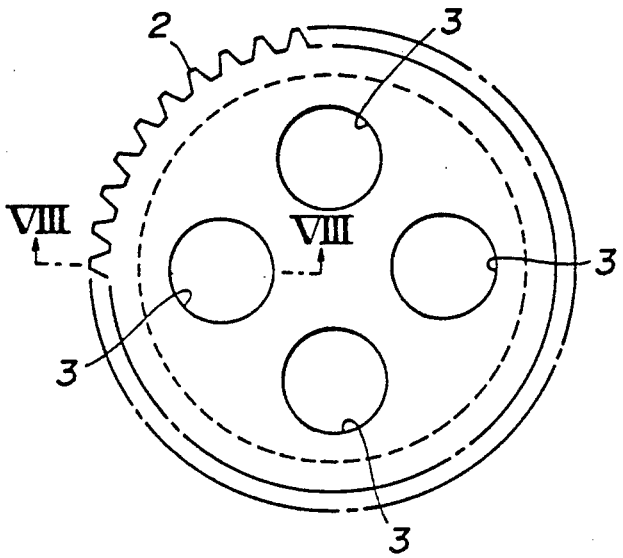
FIG. 7 is a plan view of a carrier according to a fourth embodiment of the present invention.
Figure 8:
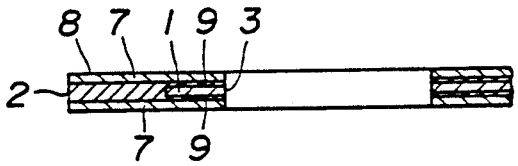
FIG. 8 is a partially enlarged sectional view taken along VIII—VIII in FIG. 7.

FIGS. 7 and 8 show the fourth embodiment of the present invention. As shown in FIG. 8, its structure is formed by laminating reinforcing layers consisting of thermo-setting resin-impregnated fiber layers 7 each having a diameter greater than that of the mica laminate sheet 1 on both surfaces of the round mica laminate sheet 1, impregnated with a thermo-setting resin 9, and bonding the reinforcing layers with each other on the outer periphery 8 of the mica laminate sheet 1 through the thermo-setting resin 9. Teeth 2 for mesh with a sun gear and an internal gear of a double-sided polisher are formed on its outer periphery in the same way as in the first embodiment, and four workpiece insertion holes 3 are bore on its disc surfaces.

This carrier is produced in the following way.

| | |
|---|---|
| epoxy resin ("Epicoat 1001", product of Yuka Shell Epoxy Co., | 40 parts |
| curing promoter ("$BF_3$ - 400", product of Sumitomo Kagaku Co.) | 1.2 parts |
| toluene | 30 parts |
| methyl ethyl ketone | 30 parts |

The materials described above are mixed inside a tank for coating to prepare an epoxy varnish having a solid content of 20–50 wt %. The prepreg of the epoxy integrated mica that is prepared by the same method as that of the first embodiment is heat-pressed to this epoxy varnish and a mica laminate sheet whose impregnated thermo-setting resin is set (0.1 mm thick) is immersed. Thereafter, drying is preformed made for about 20 minutes at 120° C. to obtain the integrated mica laminate sheet covered with the epoxy varnish (about 0.1 mm thick) which does not exhibit viscosity at normal temperature. This is punched out in a round shape to obtain the varnish-coated integrated mica laminate sheet 1.

On the other hand, while a glass fiber cloth having a number of pitches of glass fibers (450 Deniers) of 50/25 mm in the longitudinal direction and 53/25 mm in the transverse direction and having a weight of 108 g/m$^2$ and a thickness of 0.1 mm is being passed through a vertical automatic immersing dryer, the glass cloth is caused to be impregnated with the same epoxy varnish as described above and dried to provide the prepreg of the reinforcing material. Two prepregs of this reinforcing material, which are punched out in a diameter greater than that of the mica laminate sheet 1 are prepared. While the mica laminate sheet 1 is interposed at both of its surfaces between these thermo-setting resin impregnated fiber layers 7, it is heat-pressed at 160° C. and a pressure of 50 kgf/cm$^2$ for one hour. The product is taken out after cooling to obtain the laminated body of the thermo-setting resin impregnated fiber layers and the integrated mica laminate sheet. This laminated body has a construction wherein the epoxy varnish of the surface of the integrated mica laminate sheet causes fluidization and is extruded to the outer periphery 8 of the integrated mica laminate sheet when the two prepregs of the reinforcing material and the integrated mica laminated sheet interposed between them are heat-pressed. This epoxy varnish bonds mutually the reinforcing materials and is set while filling between the reinforcing materials. Teeth 2 for mesh with a sun gear and an internal gear of a double-face polisher are formed on its outer periphery 8 and a plurality (four, in this embodiment) of workpiece insertion holes are formed on the disc surfaces of the laminated body to obtain a carrier for holding workpieces.

In comparison with the conventional glass fiber-reinforced epoxy plate, this carrier has a smaller warp ratio and bending deformation. As a result of polishing tests of silicon wafers, durability was found to be at least 150 hours. Furthermore, since the mica-containing layer does not exist at the edge of the teeth, the scatter of fine mica powder due to impact does not occur and consequently there is no possibility at all of adverse influences on the workpieces. The measurement results of the properties are shown in Table 1.

FIFTH EMBODIMENT

The carrier of this embodiment has exactly the same construction as that of the fourth embodiment, except that titanium oxide is added as an inorganic filler to the thermo-setting resin 9 used in the fourth embodiment. It is produced in the following way.

| | |
|---|---|
| epoxy resin ("Epicoat 1001" product of Yuka Shell Epoxy Co.) | 300 parts |
| curing promoter("$BF_3$ - 400", product of Sumitomo Kagaku Co.) | 20 parts |
| titanium oxide ("Epoxy white-1003", product of Toyo Ink Co.) | 100 parts |
| toluene | 200 parts |
| methyl ethyl ketone | 200 parts |
| methanol | 100 parts |

The materials described above are mixed uniformly to prepare an epoxy varnish. The same mica laminate sheet (about 0.1 mm thick) as used in the fourth embodiment is immersed in this epoxy varnish and then dried to prepare a mica laminated sheet coated with the epoxy varnish containing the inorganic filler. A carrier is obtained by using this mica laminate sheet and prepregs of the same reinforcing material as that of the fourth embodiment in the same way as in the fourth embodiment.

Since the two reinforcing layers are bonded at the teeth portion of this carrier by the epoxy resin containing the inorganic filler, wear resistance of the teeth is at least 300 hours and is found particularly excellent as a result of polishing tests of silicon wafers. Scatter of fine mica powder due to impact does not occur. The measurement results of the properties are shown in Table 1.

Besides titanium oxide, suitable examples of the inorganic filler include calcium carbonate, aluminum oxide and graphite and one or at least two of them may be used in mixture.

Figure 9:
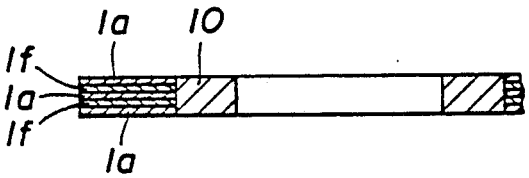
FIG. 9 is a partially enlarged sectional view according to a further embodiment of the present invention.

Besides the constructions shown in the foregoing first to fifth embodiments, there is the following means for reducing the warp ratio of the carrier plate and for preventing the contact of the workpieces with the carrier metal. Namely, as shown in FIG. 9, for example, mica laminate sheets 1*a* and 30 μ-thick stainless paper 1*f* are laminated alternately and are heat-pressed at a pressure of 40 kgf/cm$^2$ and at 160° C. for one hour and are then cooled to obtain a 0.35 mm-thick laminate sheet. In comparison with the conventional glass fiber-reinforced epoxy plate, this sheet has a smaller warp ratio at the same thickness. The laminate sheet described above is cold punched to form the peripheral teeth and the workpiece insertion holes. A curable resin composition consisiting of 100 parts of an epoxy resin and 40 parts of a curing promoter is coated onto the inner peripheral surface of the insertion holes and is left standing for 24 hours for curing. In this manner the metal is not exposed on the inner peripheral surface of the insertion holes and adverse influences resulting from the contact of the workpieces with the metal can thus be prevented.

In place of coating and curing the thermo-setting resin composition onto the inner peripheral surface of the insertion holes, it is possible to punch out an integrated mica laminate. This is produced by laminating separately a plurality of mica laminate sheets and heat-pressing them into a ring-like form to obtain a ring 10 having an outer diameter substantially equal to the inner diameter of the insertion holes. This ring 10 is fitted after applying an adhesive to the inner peripheral surface of the insertion holes.

Wear resistance of the teeth can be improved in the following way. For example, the integrated mica laminate sheets 1*c*, 1*c'*, 1*e*, 1*e'* covering the tooth surface shown in the second and third embodiments may be disposed or the inner portion more inward from the edge portions of the metal plates 4, 5 so that only the metal is exposed at the edge of the teeth.

TABLE 1

| | thickness (mm) | warp ratio (%) | impact strength (mm) 15° | 30° |
|---|---|---|---|---|
| first embodiment | 0.35 | 0.2 | 2 | break |
| second embodiment | 0.35 | 0.2 | 0 | 0 |
| third embodiment | 0.35 | 1.2 | 0 | 0 |
| fourth embodiment | 0.35 | 1.0 | 0.3 | 0.6 |
| fifth embodiment | 0.35 | 1.0 | 0.2 | 0.5 |
| Comparative Example (glass fiber-reinforced epoxy sheet) | 0.35 | 2.6 | 0.5 | 0.8 |

(Remarks) The measurement values are each a mean value obtained by repeating the test five times.

As described above, the carrier in accordance with the present invention is composed of the integrated mica laminated sheet impregnated with the thermo-setting resin. Accordingly, the flake-like mica plates having a large aspect ratio are completely integrated to form a unitary structure and surfaces of the mica plates are arranged parallel, with the result that a carrier has high stiffness, though it is thin, and its thickness accuracy is in the order of $0.35 \pm 0.02$ mm. The warp ratio can be made below 1.5% even when its thickness is reduced. Furthermore, since surface bonding is performed, the mica plates can be integrated by a small impregnation amount of thermo-setting resin of from about 10 to about 20 wt %, the large elastic coefficient ($6.5 \times 10^4$ to $7.0 \times 10^4$), as one of the characteristic properties of mica is not lost but maintained, and any breakage of the workpiece due to a collision or contact with the integrated mica laminate sheet does not occur. This, the life of the carrier of the present invention is longer than that of the conventional carrier, and since punching work can be made by known cold punching, the cost of production of the carrier can be reduced.

Furthermore, the mechanical strength of the teeth portions can be improved by employing the laminate material of the integrated mica laminate sheet and the metal ring plate, and the overall strength of the carrier, inclusive of the teeth can be improved by employing the laminate structure of the integrated mica laminate sheet and the bored metal sheet. If the portions of the metal plate around the holes is reinforced strongly by the integrated mica laminate sheet, it is possible to prevent the direct contact of the workpiece to be polished with the metal plate and to prevent the breakage of the workpiece.

When both surfaces of the integrated laminate sheet is laminated by the thermo-setting resin impregnated layers through the thermo-setting resin and the tooth portions of this mica laminate sheet on its outer periphery are bonded by the fiber layers, the warp ratio and bending deformation are smaller than those of the conventional glass fiber reinforced epoxy sheet and wear resistance of the teeth is higher. Since mica does not exist at the end portion of the teeth, fine powder of mica does not scatter during use due to impact and does not exert adverse influences on the workpieces. Furthermore, particularly when the inorganic filler is mixed in the thermo-setting resin described above, wear resistance of the teeth becomes further higher.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings contemplated for carrying out the present embodiments falling within the description of the appended claims.

What is claimed is:

1. A carrier for supporting workpieces to be ground, wherein said carrier is meshed with a sun gear and an internal gear of a double-sided polisher, comprising, a mica laminate composed mainly of a plurality of mica sheets and impregnated with a thermo-setting resin, said mica laminate having teeth on its periphery for mesh with said sun gear and said internal gear and a plurality of holes for holding workpieces therein.

2. A carrier for supporting workpieces to be ground wherein said carrier is meshed with a sun gear and an internal gear of a double-sided polisher, comprising, a mica laminate composed mainly of a plurality of mica sheets and impregnated with a thermo-setting resin and a metal ring embedded inside a peripheral edge of said mica laminate to form a laminate body, said laminate body having teeth on its periphery for mesh with said sun gear and said internal gear and a plurality of holes for holding workpieces therein.

3. A carrier for supporting workpieces to be ground, wherein said carrier is meshed with a sun gear and an internal gear of a double-sided polisher, comprising, a mica laminate composed mainly of a plurality of mica sheets and impregnated with a thermo-setting resin and a bored metal plate embedded between layers of said mica laminate to form a laminate body, said laminate body having teeth on its periphery for mesh with said sun gear and said internal gear and a plurality of holes for holding workpieces therein.

4. A carrier for supporting workpieces to be ground wherein said carrier is meshed with a sun gear and an internal gear of a double-sided polisher, comprising: a mica laminate composed mainly of a plurality of round shaped mica sheets and impregnated with a thermo-setting resin and fiber layers impregnated with a thermo-setting resin and having a diameter greater than a diameter of said round shaped mica sheets, said fiber layers being laminated and bonded on both surfaces of said mica laminate, said mica laminate having teeth on its periphery for mesh with said sun gear and said internal gear and a plurality of holes for holding workpieces therein.

5. A carrier according to claim 4, wherein an inorganic filler is mixed with said thermo-setting resin as a bonding layer of said fiber layers.

* * * * *